US005307988A

United States Patent [19]

Focke et al.

[11] Patent Number: 5,307,988

[45] Date of Patent: May 3, 1994

[54] SOFT PACK FOR PAPER TISSUES

[75] Inventors: Heinz Focke; Harald Gosebruch, both of Verden, Fed. Rep. of Germany

[73] Assignee: Focke & Co., (GmbH & Co.), Verden, Fed. Rep. of Germany

[21] Appl. No.: 984,473

[22] Filed: Dec. 2, 1992

[30] Foreign Application Priority Data

Dec. 4, 1991 [DE] Fed. Rep. of Germany ..... 4139924

[51] Int. Cl.[5] ..... B65D 65/32

[52] U.S. Cl. ..... 229/238; 206/494; 229/309; 229/924; 229/926

[58] Field of Search ..... 206/494; 229/123.1, 229/123.3, 238, 309, 924, 926, DIG. 9; 383/205; 40/312

[56] References Cited

U.S. PATENT DOCUMENTS

| | | | |
|---|---|---|---|
| 3,190,443 | 6/1965 | Kingsley . | |
| 3,231,949 | 2/1966 | Phipps . | |
| 4,679,693 | 7/1987 | Forman | 383/205 |
| 4,723,301 | 2/1988 | Chang . | |
| 4,739,879 | 4/1988 | Nakamura | 383/205 |
| 4,811,848 | 3/1989 | Jud | 383/205 |
| 4,863,064 | 9/1989 | Dailey, III | 206/494 |
| 5,018,625 | 5/1991 | Focke et al. | 229/924 |
| 5,096,113 | 3/1992 | Fock | 229/238 |

FOREIGN PATENT DOCUMENTS

| | | | |
|---|---|---|---|
| 30601 | 6/1981 | European Pat. Off. . | |
| 376612 | 4/1990 | European Pat. Off. | 229/123.1 |
| 396967 | 11/1990 | European Pat. Off. . | |
| 451861 | 10/1991 | European Pat. Off. . | |
| 1732309 | 5/1956 | Fed. Rep. of Germany . | |
| 1262872 | 3/1968 | Fed. Rep. of Germany . | |
| 8708274.8 | 9/1987 | Fed. Rep. of Germany . | |
| 3205332 | 1/1988 | Fed. Rep. of Germany . | |
| 2803475 | 6/1988 | Fed. Rep. of Germany . | |
| 3700988 | 7/1988 | Fed. Rep. of Germany . | |
| 3911779 | 10/1990 | Fed. Rep. of Germany . | |
| 3915192 | 11/1990 | Fed. Rep. of Germany . | |
| 393199 | 6/1933 | United Kingdom | 229/123.1 |

*Primary Examiner*—David T. Fidei
*Attorney, Agent, or Firm*—Sughrue, Mion, Zinn, Macpeak & Seas

[57] ABSTRACT

A soft pack for paper tissues is disclosed. Soft packs for paper tissues which have a reclosable tear-open flap (21) are often provided with large-surfaced wide adhesive labels (24) to ensure a better stability. These adhesive labels are made by punching from a web of material (26) corresponding to the width of the adhesive label (24). When the adhesive is applied, an area is left out to form an adhesive-free grip tab (25). The grip tab (25) is color-coded with an appropriate coating. A marginal strip (31) is left free from the adhesive and free from the colored coating. The punch cut is applied in the region of this strip (31).

12 Claims, 3 Drawing Sheets

SOFT PACK FOR PAPER TISSUES

BACKGROUND OF THE INVENTION

The invention relates to a soft pack for cellulose products, especially for stacks of folded paper tissues, formed from a blank of thin flexible packaging material, especially plastic foil, which encloses the pack contents on all sides, with a tear-open flap being formed in the region of a pack side, preferably in the region of a front wall, and being defined by a perforation line or other kinds of weakening lines, which tear-open flap is partially covered by a large-surfaced adhesive label having an adhesive-free grip tab for opening and reclosing the soft pack.

For some time now, packages for folded paper tissues have been equipped with a reclosable opening aid. A tear-open flap is defined by perforation lines in the region of the front wall of the pack. This tear-open flap can be opened and again moved into the closed position with the aid of an adhesive strip or adhesive label which is attached to the tear-open flap. The adhesive strips used in known packs are relatively narrow (approximately 1 cm wide), which constitutes a drawback for the handling of the pack and for the dimensional stability of the tear-open flap. The advantage of the adhesive strip (tape) is its inexpensive manufacture by way of severance from a continuous web coated with an adhesive on one side. The adhesive-free grip end of the adhesive strip is usually formed from a foil piece attached to the coated adhesive face.

Although the substantially wider adhesive labels are easier to handle compared to adhesive strips, manufacture is complicated because the adhesive labels have to be produced on a carrier layer and have to be pulled off this carrier layer in order to be attached to the pack. DE-GM 87 08 274.8 discloses various embodiments of a pack having these sort of adhesive labels. The special contours of the adhesive labels require a substantially greater amount of material for the manufacture of the labels.

SUMMARY OF THE INVENTION

The invention is based on the object to overcome the shortcomings of the adhesive labels of such soft packs, especially the complicated and expensive production, and at the same time to retain their advantages by means of a special design of the adhesive label and other measures.

To attain this object, the soft pack which is equipped with an adhesive label is characterized in that the adhesive label is severed without creating waste by punching from a continuous web of material having a one-sided adhesive coating.

For this purpose, the adhesive label is designed according to the invention in such a way that lateral boundaries or side edges correspond to the extension of a web of material having the width of the adhesive labels. The transversely directed boundaries, i.e. transverse edges, may be provided with special contours, providing that the oppositely situated transverse edges of an adhesive label correspond to one another, so that the transverse edges of adjacent adhesive labels within the web of material are formed by a single punch cut without any waste. According to the invention, the transverse edges have an especially convex and concave curved design.

According to the invention, the adhesive-free grip end of the adhesive label is formed during the production of the web of material, that is to say during the coating of the web of material with an adhesive by way of not applying adhesive to a marginal portion of the adhesive label. Furthermore, the adhesive-free portion, i.e. the grip tab, is delimited from the remaining portion of the adhesive label by a special coating, especially a coloured coating. A marginal strip in the region of the grip tab is free from adhesive and free from a coloured coating. In this region, the punch cut is applied in order to sever the adhesive label from the web. The adhesive-free and colour-free marginal strip offers a tolerance space for applying the punch cut.

Further details of the invention relate to the structural design of the adhesive label and the web of material in conjunction with the package.

BRIEF DESCRIPTION OF THE DRAWINGS

An exemplary embodiment of the invention will be described below in detail with reference to the drawings, in which.

DESCRIPTION OF A PREFERRED EMBODIMENT

Figure 1:
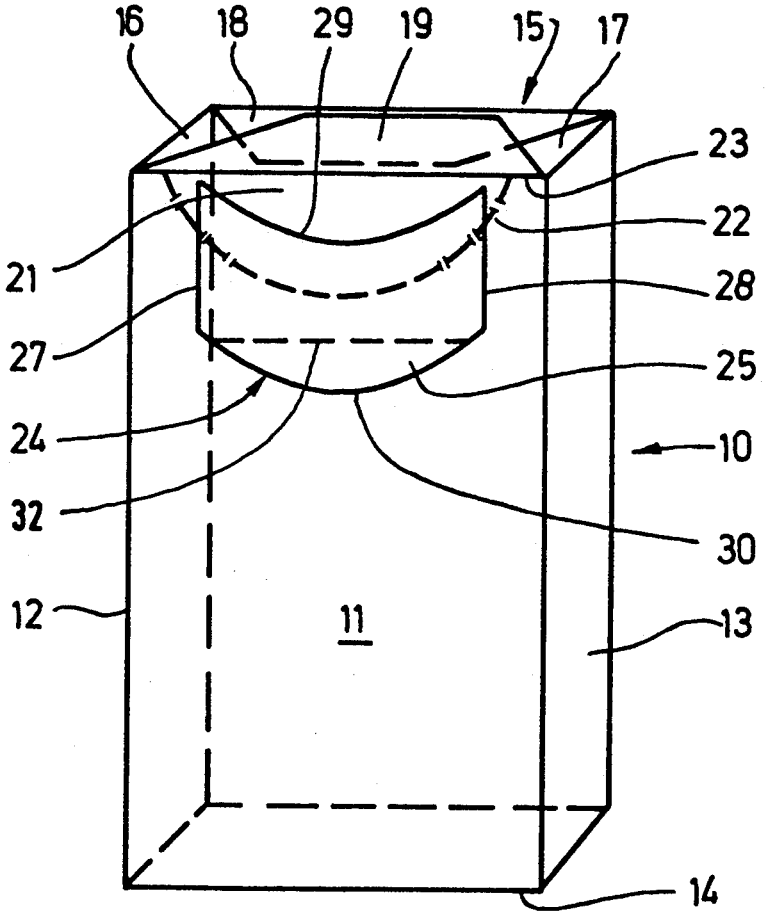
FIG. 1 shows a perspective front view of a cuboid soft pack with an adhesive label acting as an opening aid.
Figure 2:
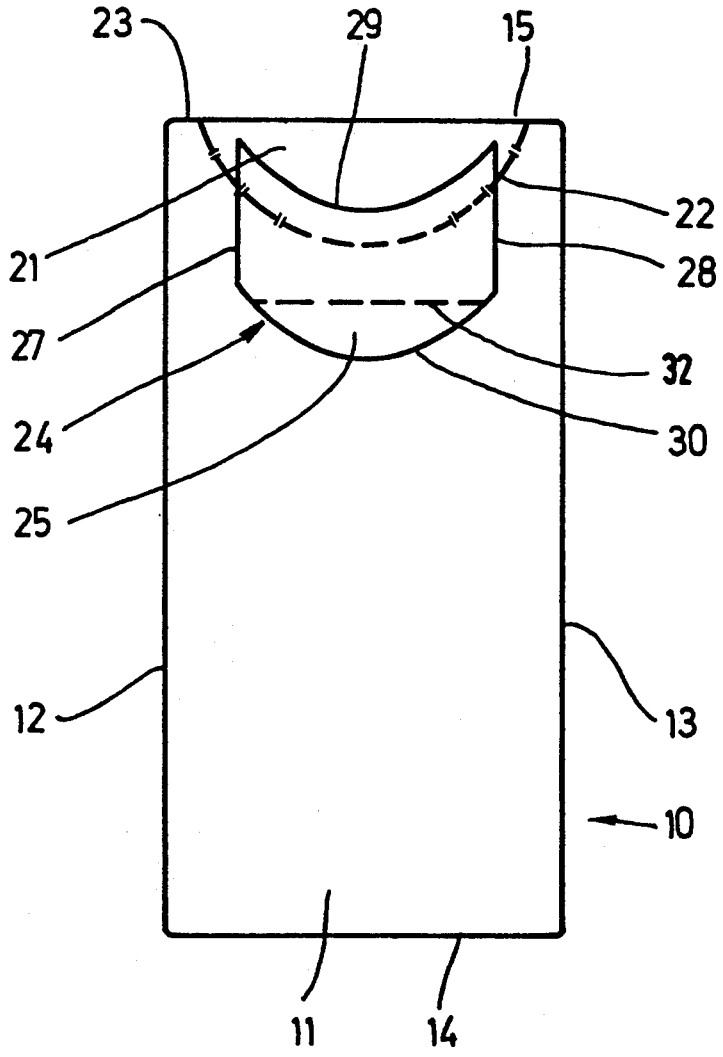
FIG. 2 shows a view of the front side of the pack illustrated in FIG. 1.

The exemplary embodiment of a package as illustrated in FIGS. 1 and 2 has a cuboid shape. The pack contents preferably take the form of a stack of folded paper tissues. These tissues are surrounded by an outer wrapper 10 which is usually made of thin and thermally sealable (plastic) foil. Alternatively, the wrapper may be made of paper or a paper-like material instead.

The pack is designed such that the outer wrapper forms a front wall 11, a corresponding rear wall, two oppositely situated narrow upright side walls 12 and 13 as well as a bottom wall 14 and an end (top) wall 15.

The outer wrapper 10 is formed from a rectangular blank which forms longitudinal tabs (not shown) which are connected to one another in the region of one of the side walls 12, 13. Additionally, a special fold is formed in the region of the bottom wall 14 and the end (top) wall 15. This envelope-like fold comprises side tabs 16, 17 as well as an inner longitudinal tab 18 and an outer longitudinal tab 19. The longitudinal tabs have a trapezoidal shape. These folding tabs are connected to one another in the region of a mutual overlap.

The package which is designed in this manner is provided with an opening aid which has a tear-open flap 21 in the region of the front wall 11. In this case, the tear-open flap 21 is directed towards the end wall 15. In the open condition, the tear-open flap 21 forms a withdrawal opening in the region of the front wall 11 adjacent the end wall 15. In the presently described embodiment, the tear-open flap 21 is bounded by a curved perforation line 22. When the pack is used for the first time, the perforation line 22 is severed, such that the tear-open flap 21 is released from the remaining portion of the front wall 11. The perforation line 22 ends at an upper transverse edge 23 located between front wall 11 and end (top) wall 15.

The tear-open flap 21 interacts with an adhesive label 24. The latter is attached in the region of the tear-open flap 21, in particular in such a way that a lower portion is connected adhesively to the front wall 11 beyond the tear-open flap 21 and another portion is connected adhesively to the tear-open flap 21. A free lower marginal portion of the adhesive label 24 is provided with an adhesive-free grip tab 25 which rests freely on the front wall 11 and permits a grasping of the adhesive label 24 for opening the pack. First, the adhesive label 24 is pulled off the front wall 11. If the pack is opened for the first time, the perforation line 22 is severed thereafter. The tear-open flap 21 is released and, as a result of its connection with the adhesive label 24, it is moved into the open position by the adhesive label. To reclose the pack, the adhesive label 24 is moved back together with tear-open flap 21 into the position illustrated in FIGS. 1 and 2.

The adhesive label 24 is formed from a slightly thicker (plastic) foil which is coated with an adhesive on the side which faces the front wall 11 or the tear-open flap 21, such that the area of the grip tab 25 is left out. The adhesive label 24 differs from a tape especially with regard to size, in particular width. The adhesive label 24 has a width which corresponds to at least half the width of the front wall 11. As a result, most of the perforation line 22 and the tear-open flap 21 is covered by the adhesive label 24.

Figure 3:
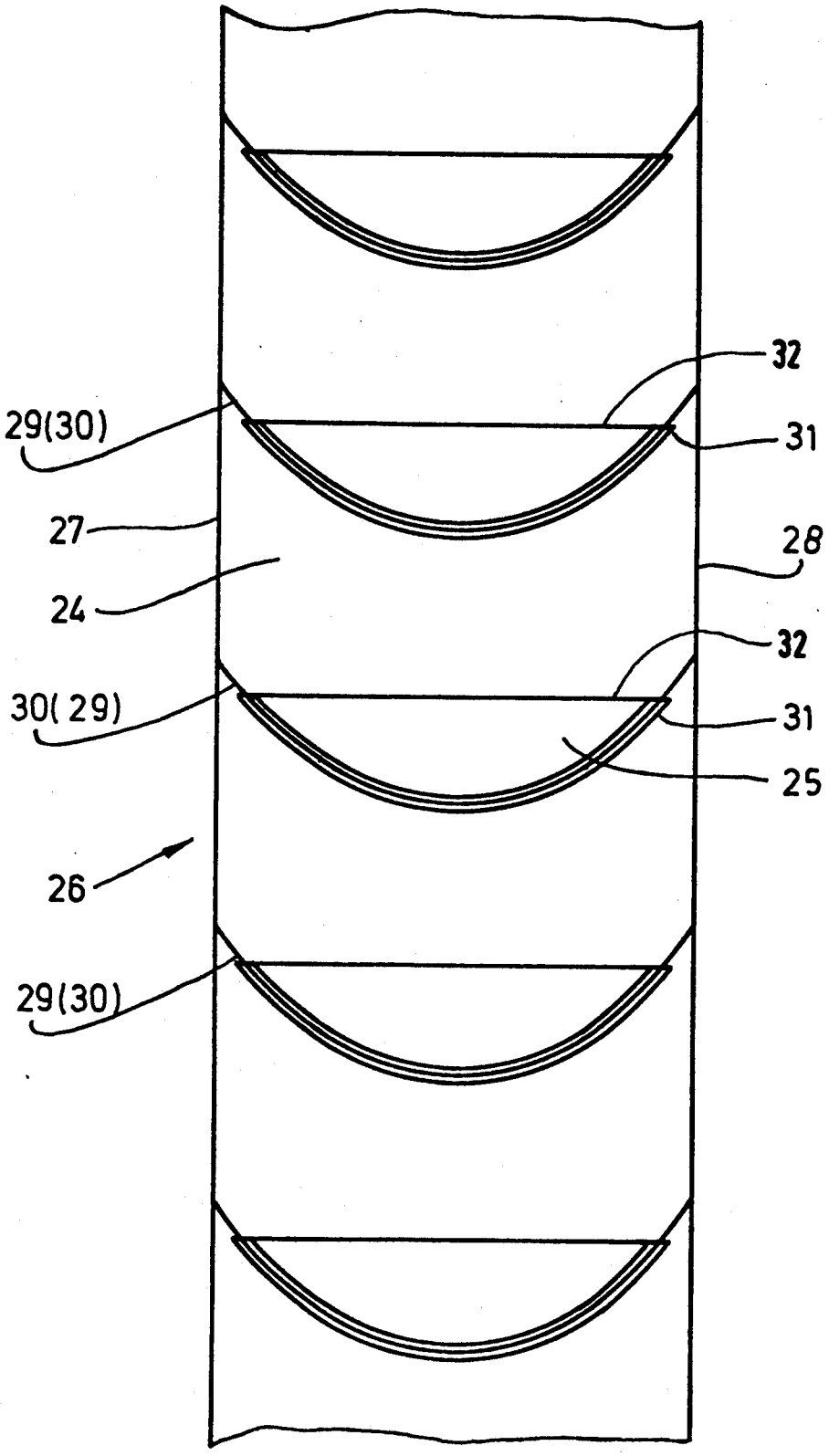
FIG. 3 shows a section of a web of material for the production of adhesive labels.

The adhesive label 24 is produced by way of being severed from a continuous web of material 26 (FIG. 3). The adhesive is applied to one side of this web by a suitable glue applicator device. The portions of the grip tab 25 are left out. This can be accomplished, for example, with glue applicator rollers having glue applicator surfaces with appropriate gaps. Additionally, the grip tab 25 is provided with a coloured coating on the adhesive side of the adhesive label 24.

The width of the web of material 26 corresponds to the width of the adhesive label 24. Accordingly, the label is bounded by parallel side edges 27, 28. A transversely directed punch cut severs one adhesive label 24 at a time from the web of material 26. This punch cut is applied such that transverse edges 29, 30 of the adhesive label also extend parallel to one another. As a result, the adhesive labels are produced without any waste. In the illustrated exemplary embodiment, the transverse edges 29, 30 extend in a curved shape and are adapted to the shape of the perforation line 22, such that they extend nearly parallel relative to the perforation line 22. Accordingly, the upper transverse edge 29 has a concave design and the lower transverse edge 30 a convex design.

As a result, the grip tab 25 has a tongue-like shape for easy grasping. The grip tab 25, however, has a smaller width than the adhesive label 24, so that the latter is connected adhesively to the front wall 11 in the region of the side edges 27, 28. The portion of the adhesive label 24 which is provided with an adhesive is delimited from the grip tab 25 by a rectilinear and transversely extending adhesive margin 32.

In the region of the grip tab 25 and along the transverse edges 29 and 30 of successive adhesive labels 24, a strip 31 is left free within the web of material 26, namely free from adhesive and free from the coloured coating which marks the grip tab 25. The punch cut is applied within this strip 31. Expediently, the strip 31 has a width of 0.5 mm to 1 mm. As a result, it is prevented that a marginal strip of the coloured coating of the grip tab 25 appears at the upper transverse edge 29 of an adjacent adhesive label 24 if the punch cut is applied inaccurately. Additionally, it is also prevented that an adhesive-coated marginal strip of an adhesive-coated portion of the adhesive label 24 is left at the lower transverse edge 30 in the region of the grip tab 25 of the adjacent adhesive label 24 if the punch cut is applied inaccurately.

In the manufacture of packs according to FIG. 1, adhesive labels 24 are expediently produced from the web of material 26 within the packaging machine and are applied to the pack immediately after severance from the web. The web of material 26 is provided in the form of a reel.

We claim:

1. In a soft pack containing stacks of folded paper tissues, said pack being formed from a blank of thin flexible packaging material, which enclosed the pack contents on all sides, said pack having a tear-open flap (21) which is formed in a pack front wall (11), which is defined by a perforation line (22) in said front wall (11) and which is partially covered by a large-surfaced adhesive label (24) having an adhesive-free grip tab (25) for opening and reclosing the soft pack, the improvement wherein:

a) the adhesive label (24) is severed without creating waste by punching from a continuous web (26) of material having a width and having an adhesive coating on only one side;

b) the adhesive label (24) has a width that is identical to the width of the web (26) of material;

c) the adhesive label (24) has rectilinear side edges (27,28) which extend parallel to one another and which correspond to side edges of the web (26) of material (26);

d) the adhesive label has a lower portion, which engages said front wall (11) of the pack, and an upper portion secured to said tear-open flap (21); and e) the adhesive label (24) has a pair of transverse edges (29, 30) which extend between said side edges (27, 28) and parallel to one another in non-linear, curved fashion so that said lower portion of the adhesive label (24) has a downwardly directed convex shape, and so that said upper portion of the adhesive label (24) has a corresponding downwardly directed concave shape.

2. The pack as claimed in claim 1, wherein the adhesive-free grip tab (25) is part of the convex shaped lower portion of the adhesive label (24).

3. The pack as claimed in claim 2, wherein the perforation line (22) also is curved and is substantially parallel to said transverse edges (29, 30).

4. The pack as claimed in claim 3, wherein said width of said label is at least one-half that of said front wall (11) so that said label cover a majority of said perforation line (22) and said tear-open flap (21).

5. The pack as claimed in claim 1, wherein a marginal strip (31) located in the region of the grip tab (25) and having a curved shape corresponding to the curve of the transverse edges (29, 30) is free from adhesive, and wherein a transversely directed punch cut for severing the adhesive label (24) from the web of material (26) is applied in the region of said strip (31).

6. The pack as claimed in claim 2, wherein the adhesive-free grip tab (25) has a smaller width that the adhesive label (24).

7. The pack as claimed in claim 5, wherein the adhesive-free grip tab (25) has a smaller width that the adhesive label (24).

8. The pack as claimed in claim 1, wherein the transverse edges (29, 30) of the adhesive label (24) extend approximately parallel to a perforation line (22) which bounds the tear-open flap (21).

9. The pack as claimed in claim 2, wherein the transverse edges (29, 30) of the adhesive label (24) extend approximately parallel to a perforation line (22) which bounds the tear-open flap (21).

10. The pack as claimed in claim 5, wherein the transverse edges (29, 30) of the adhesive label (24) extend approximately parallel to a perforation line (22) which bounds the tear-open flap (21).

11. The pack as claimed in claim 6, wherein the transverse edges (29, 30) of the adhesive label (24) extend approximately parallel to a perforation line (22) which bounds the tear-open flap (21).

12. The pack as claimed in claim 7, wherein the transverse edges (29, 30) of the adhesive label (24) extend approximately parallel to a perforation line (22) which bounds the tear-open flap (21).

* * * * *